United States Patent [19]

Sorensen

[11] 4,216,985

[45] Aug. 12, 1980

[54] WINDOW LOCK OPERATING DEVICE

[75] Inventor: Bendt D. Sorensen, Holte, Denmark

[73] Assignee: V. Kann Rasmussen Holding A/S, Denmark

[21] Appl. No.: 23,389

[22] Filed: Mar. 23, 1979

[30] Foreign Application Priority Data

Apr. 20, 1978 [DK] Denmark ..... 1733/78

[51] Int. Cl.[2] ..... E05C 13/00

[52] U.S. Cl. ..... 292/336.3; 292/359; 74/527

[58] Field of Search ..... 292/336.3, 347, 227, 292/359; 74/527, 529

[56] References Cited

U.S. PATENT DOCUMENTS

| | | | |
|---|---|---|---|
| 2,196,478 | 4/1940 | Simpson | 292/359 |
| 2,275,128 | 3/1942 | Campbell | 292/227 X |
| 2,801,869 | 8/1957 | George | 292/359 X |
| 3,685,036 | 8/1972 | Torok | 292/359 |

FOREIGN PATENT DOCUMENTS

| | | | |
|---|---|---|---|
| 18586 | of 1908 | United Kingdom | 292/359 |

*Primary Examiner*—Richard E. Moore

*Attorney, Agent, or Firm*—Lane, Aitken, Ziems, Kice & Kananen

[57] ABSTRACT

In a window lock operating device comprising an L-shaped handle member having a short arm connected to rotatable lock operating shaft and a long arm serving as a grip, a tiltable lever is provided in said short arm and is urged by a spring toward a position in which one end of the lever engages a retaining notch in a bearing member to be firmly secured on the window. A push rod that is displaceable in the long arm of the handle member may be operated to tilt the lever out of engagement with the notch against the force of the spring.

1 Claim, 1 Drawing Figure

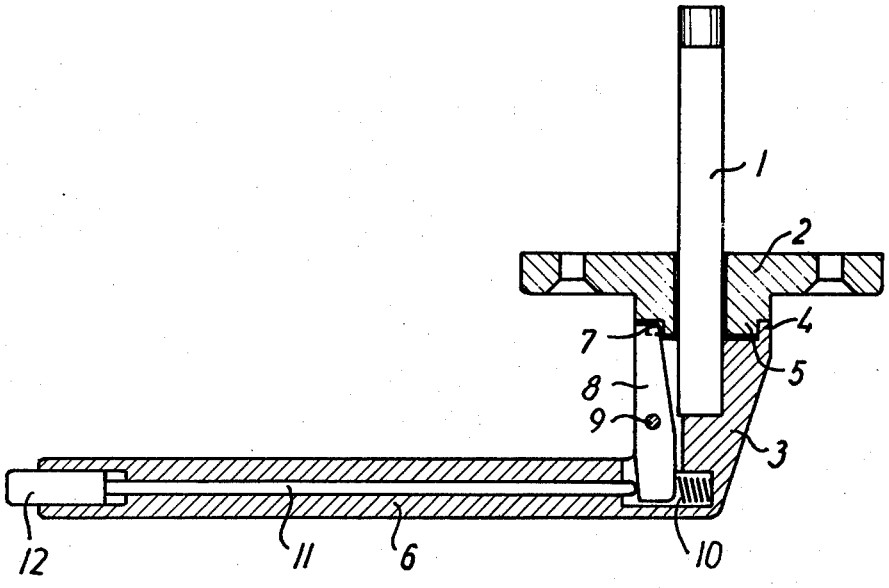
1
2
4
5
7
8
9
3
12
11
6
10

WINDOW LOCK OPERATING DEVICE

BACKGROUND OF THE INVENTION

In windows comprising a movable sash having a locking system including one or more locking members cooperating with the window frame and a handle member operatively connected to said locking system, it is known to provide a mechanism for arresting the shaft in its locking position.

The arresting mechanism shall prevent an unintentional turning of the handle member away from the locking position and functions as a so-called children's safety device. Such safety devices are known in numerous embodiments, either as separate devices additional to the normal operating means of the window, or as integral parts thereof. When the operating means comprise a rotatable handle carried by the sash or the frame of the window and arranged to activate the locking members thereof, this handle may be associated with a key operated lock that has to be released in order to allow the handle to be turned away from the closing or locking position. When utilized in the intended manner, the lock provides an absolute guarantee against an unintentional opening of the window but, of course, only on the condition that the lock is operated by means of the key upon re-closure of the window. Similarly, the separate safety devices require an extra manual operation in order to serve their purpose.

SUMMARY OF THE INVENTION

When compared with this prior art, the window lock operating device of the invention is characterized in that the arresting mechanism comprises a tiltable lever that is housed in the short arm of the handle member and by a spring is urged toward a position in which one end of the lever engages a retaining notch in a bearing member to be firmly secured to the window, the lever being movable away from this engaged position, against the force of the spring, by means of a push rod which is displaceable in the long arm of the handle member and is provided with press-button at the free end of this arm.

When grasping around the long arm of the handle member with four fingers of a hand, an adult person will find it very easy and almost natural to use the thumb of the same hand to push the press-button inwardly against the force of the spring so as to disengage the arresting mechanism, and then turn the handle around the axis of the short arm. However, a child will not naturally perform such a double operation of the handle member, viz. pushing the press-button and turning the handle, and particularly not when the force of the spring is suitably high. When the window is re-closed and the handle is turned back, the press-button may be left unattended as the spring force will automatically re-engage the lever in the retaining notch. Thus, the arresting mechanism will never fail due to inattention or oversight.

BRIEF DESCRIPTION OF THE DRAWING

The drawing illustrates a preferred embodiment of the invention, showing substantially a horizontal section thereof.

DETAILED DESCRIPTION OF THE PREFERRED EMBODIMENT

The device illustrated on the drawing is intended to be mounted on the lower frame member, not shown, of a tiltable window sash having a built-in locking system that is activated by means of a shaft 1 having a square cross section. This shaft is journalled in a bearing member 2 to be fastened on the sash frame member by means of screws and from which the shaft extends into the short arm 3 of an L-shaped handle member to which the end of the shaft is secured. A collar 4 on the arm 3 fits around a circular projection 5 on the bearing member 2. In its side turning the same way as the long arm 6 of the handle member, the projection is provided with a retaining notch 7 cooperating with one end of a tilting or rocking lever 8 which is journalled on a pin 9 in a pocket in the arm 3, the opposite end of the lever being permanently urged by a pressure spring 10 tending to maintain the lever 8 in engagement with the notch 7 so as to prevent rotation of the handle member 3,6 and the shaft 1.

This locking effect may be released by means of a push rod 11 that is displaceable in the long arm 6 of the handle member and with one end contacts the tiltable lever 8 opposite the spring 10, the other end of the push rod carrying a press-button 12 which projects slightly from the end face of the arm 6. When a pressure is exerted on the button 12, the lever 8 is tilted out of its engagement with the retaining notch 7, thus permitting the handle member with the shaft 1 to be rotated. By this rotation the end or nose portion of the lever slides along the periphery of the projection 5, and when the handle member is returned to its starting position said end or nose portion re-engages the retaining notch.

As mentioned in the foregoing, the force of the spring 10 may be adjusted that an adult person may easily operate the press-button 12 whereas it will be impossible or at least difficult for a child to do so. If desired, the spring force may be adjustable by means of a screw, not shown.

What I claim:

1. A window lock operating device, comprising a bearing member to be firmly secured to the window and including a rotatable lock operating shaft, an L-shaped handle member including a short arm extending substantially co-axially with said shaft and having one end portion firmly connected thereto and a long arm integral with the opposite end portion of the short arm, and a mechanism for arresting said shaft in its locking position, said arresting mechanism comprising a lever housed in said short arm and carried tiltably by a cross pin at a point intermediate the ends of the lever, a notch in said bearing member to receive the adjacent end portion of said lever in one extreme position thereof, a spring urging the lever toward said extreme position, and a push rod guided for longitudinal displacement in said long arm of the handle member and operative to tilt said lever away from said extreme position and out of engagement with said notch against the force of said spring, said push rod having a press-button projecting from the free end of said long arm.

* * * * *

UNITED STATES PATENT AND TRADEMARK OFFICE

CERTIFICATE OF CORRECTION

PATENT NO. : 4,216,985

DATED : August 12, 1980

INVENTOR(S) : BENDT DANTZER-SORENSEN

It is certified that error appears in the above—identified patent and that said Letters Patent is hereby corrected as shown below:

The patentee's name should read -- Bendt Dantzer-Sorensen --.

Signed and Sealed this

*Twenty-eighth* Day of *October 1980*

[SEAL]

*Attest:*

SIDNEY A. DIAMOND

*Attesting Officer*

*Commissioner of Patents and Trademarks*